US012637632B2

(12) United States Patent
Lumby et al.

(10) Patent No.: US 12,637,632 B2
(45) Date of Patent: May 26, 2026

(54) HYDROLYTICALLY STABLE HYDRAULIC LUBRICANT

(71) Applicant: Afton Chemical Corporation, Richmond, VA (US)

(72) Inventors: Ralph Lumby, Surrey (GB); Helen Dyer, Bracknell (GB)

(73) Assignee: Afton Chemical Corporation, Richmond, VA (US)

( * ) Notice: Subject to any disclaimer, the term of this patent is extended or adjusted under 35 U.S.C. 154(b) by 0 days.

(21) Appl. No.: 18/928,981

(22) Filed: Oct. 28, 2024

(65) Prior Publication Data

US 2026/0117141 A1 Apr. 30, 2026

(51) Int. Cl.

| | |
|---|---|
| ***C10M 137/02*** | (2006.01) |
| ***C10M 133/44*** | (2006.01) |
| ***C10M 139/00*** | (2006.01) |
| *C10N 10/04* | (2006.01) |
| *C10N 30/00* | (2006.01) |
| *C10N 30/04* | (2006.01) |
| *C10N 30/06* | (2006.01) |
| *C10N 30/10* | (2006.01) |
| *C10N 30/12* | (2006.01) |
| *C10N 40/08* | (2006.01) |

(52) U.S. Cl.

CPC ..... *C10M 137/02* (2013.01); *C10M 133/44* (2013.01); *C10M 139/00* (2013.01); *C10N 2010/04* (2013.01); *C10N 2030/04* (2013.01); *C10N 2030/06* (2013.01); *C10N 2030/10* (2013.01); *C10N 2030/12* (2013.01); *C10N 2030/45* (2020.05); *C10N 2040/08* (2013.01)

(58) Field of Classification Search

CPC ..... C10M 137/02; C10M 133/44; C10M 139/00; C10N 2010/04; C10N 2030/04; C10N 2030/06; C10N 2030/10; C10N 2030/12; C10N 2030/45; C10N 2040/08

See application file for complete search history.

(56) References Cited

U.S. PATENT DOCUMENTS

| | | | | |
|---|---|---|---|---|
| 4,522,785 | A | 6/1985 | D'Errico | |
| 5,032,300 | A | 7/1991 | O'Neil | |
| 5,137,980 | A | 8/1992 | DeGonia et al. | |
| 5,714,442 | A | 2/1998 | Wolf | |
| 5,849,675 | A * | 12/1998 | Brown | C10M 139/00 252/75 |
| 6,406,643 | B2 | 6/2002 | Linden et al. | |
| 6,436,882 | B1 | 8/2002 | Rizvi | |
| 9,090,850 | B1 * | 7/2015 | Edwards | C10M 177/00 |
| 11,788,026 | B2 * | 10/2023 | Dyer | C10M 137/105 508/281 |
| 12,018,224 | B2 | 6/2024 | Dyer et al. | |
| 2003/0134753 | A1 | 7/2003 | Stunkel et al. | |
| 2007/0060486 | A1 | 3/2007 | Singh et al. | |
| 2008/0029430 | A1 | 2/2008 | Loh et al. | |
| 2009/0105102 | A1 | 4/2009 | Rapenne-Jacob et al. | |
| 2009/0247438 | A1 * | 10/2009 | Wright | B08B 9/032 508/390 |
| 2010/0009881 | A1 * | 1/2010 | Ryan | C10M 161/00 508/440 |
| 2010/0099589 | A1 * | 4/2010 | Ryan | C10M 141/06 508/279 |
| 2010/0130394 | A1 | 5/2010 | Tsubouchi | |
| 2010/0144563 | A1 * | 6/2010 | Devlin | C10M 141/10 508/108 |
| 2011/0212864 | A1 | 9/2011 | Rapenne-Jacob et al. | |
| 2014/0342957 | A1 | 11/2014 | Donnelly et al. | |
| 2015/0133352 | A1 | 5/2015 | Esche et al. | |
| 2016/0122680 | A1 | 5/2016 | Watts et al. | |
| 2018/0119043 | A1 | 5/2018 | Broekhof et al. | |
| 2018/0208872 | A1 | 7/2018 | Elliott et al. | |
| 2019/0085256 | A1 * | 3/2019 | Kumar | C10M 137/10 |
| 2019/0225909 | A1 * | 7/2019 | Miller | C10M 169/04 |
| 2023/0055442 | A1 * | 2/2023 | Dyer | C10M 161/00 |

FOREIGN PATENT DOCUMENTS

| | | | |
|---|---|---|---|
| CA | 1077047 | A | 5/1980 |
| CA | 2442697 | A1 | 10/2002 |
| EP | 0365476 | A1 | 4/1990 |
| EP | 0821053 | A2 | 1/1998 |

(Continued)

OTHER PUBLICATIONS

Saji, Viswanathan S., "A Review of Recent Patents in Corrosion Inhibitors," Recent Patents on Corrosion Science, 2010, 2, pp. 6-12.

(Continued)

*Primary Examiner* — Ellen M Mcavoy

(74) *Attorney, Agent, or Firm* — Honigman LLP

(57) ABSTRACT

Lubricant compositions may provide corrosion resistance, oxidation resistance, and reduced wear for hydraulic systems. A lubricant composition may comprise an ashless dithiophosphate in an amount sufficient to provide a concentration of phosphorus ranging from 10 ppm to 250 ppm to the lubricant composition, a metal dialkyl dithiophosphate such as zinc dialkyl dithiophosphate (ZDDP) in an amount sufficient to provide a concentration of phosphorus ranging from 50 ppm to 1000 ppm to the lubricant composition, a corrosion inhibitor comprising an alkyltriazole derivative in an amount sufficient to provide a concentration of nitrogen ranging from 0.75 ppm to 100 ppm to the lubricant composition, and a major amount of a base oil.

18 Claims, No Drawings

(56) References Cited

FOREIGN PATENT DOCUMENTS

| | | | | | |
|---|---|---|---|---|---|
| EP | 0905221 | A1 | | 3/1999 | |
| EP | 1964911 | A2 | | 9/2008 | |
| EP | 2789679 | A1 | * | 10/2014 | ..... C10M 137/10 |
| GB | 867181 | A | | 5/1961 | |
| GB | 1466558 | A | | 3/1977 | |
| JP | 2005509732 | A | | 4/2005 | |
| WO | 9935219 | A1 | | 7/1999 | |
| WO | 0046325 | A1 | | 8/2000 | |
| WO | 2006053858 | A1 | | 5/2006 | |
| WO | 2010021643 | A2 | | 2/2010 | |
| WO | 2014078702 | A1 | | 5/2014 | |

OTHER PUBLICATIONS

Extended European Search Report for EP 25208222.7, dated Mar. 9, 2026.

* cited by examiner

HYDROLYTICALLY STABLE HYDRAULIC LUBRICANT

TECHNICAL FIELD

The present disclosure relates to a lubricating fluid for a hydraulic device and a method of lubricating the hydraulic device. In particular, the disclosed methods and lubricating fluids relate to a hydraulic lubricating fluid requiring a balance of antiwear, antioxidant, and hydrolytic stability performance.

BACKGROUND

A major challenge in developing hydraulic lubricants is achieving acceptable antiwear and antioxidant performance while also making the lubricant resistant to chemical decomposition in the presence of water. In the past, lubricant chemists have used various combinations of phosphorus-containing antiwear compounds in combination with benzotriazole derivatives as corrosion inhibitors to provide both good wear and oxidation protection. However, these lubricants can often suffer from hydrolytic stability issues.

SUMMARY

The present disclosure is directed to lubricant compositions. The lubricant composition may be a hydraulic lubricating fluid which exhibits both improved antiwear and corrosion resistance while being resistant to chemical decomposition in the presence of water. The lubricant composition may be hydrolytically stable and comprise metallic and ashless dithiophosphates with an alkylated triazole that is outside the class of benzotriazole corrosion inhibitors commonly used in hydraulic lubricants.

In one embodiment, a hydraulic lubricating fluid with improved hydrolytic stability is described herein.

In one embodiment, the lubricating oil composition disclosed herein comprises a major amount of an oil of lubricating viscosity and an ashless dithiophosphate, a metal dialkyl dithiophosphate, and a corrosion inhibitor comprising an alkyltriazole derivative. The corrosion inhibitor comprising an alkyltriazole derivative maybe present in an amount sufficient to provide a concentration of nitrogen ranging from 0.75 ppm to 100 ppm to the lubricant composition.

In one embodiment, the lubricating oil composition disclosed herein comprises a major amount of an oil of lubricating viscosity and an ashless dithiophosphate in an amount sufficient to provide a concentration of phosphorus ranging from 10 ppm to 250 ppm to the lubricant composition, a metal dialkyl dithiophosphate in an amount sufficient to provide a concentration of phosphorus ranging from 50 ppm to 1000 ppm to the lubricant composition, and a corrosion inhibitor comprising an alkyltriazole derivative in an amount sufficient to provide a concentration of nitrogen ranging from 0.75 ppm to 100 ppm to the lubricant composition. The metal dialkyl dithiophosphate may comprise (or be) zinc dialkyl dithiophosphate (ZDDP).

In one embodiment, the lubricating oil composition disclosed herein includes an ashless dithiophosphate which comprises 3-[[bis(2-methylpropoxy)phosphinothioyl]thio]-2-methyl-propanoic acid, ethyl 3-[[bis(1-methylethoxy) phosphinothioyl]thio]propionate, or a combination thereof.

In a further embodiment, the lubricating oil composition disclosed herein includes an ashless dithiophosphate present in an amount sufficient to provide a concentration of phosphorus ranging from 10 ppm to 40 ppm to the lubricant composition.

In yet another embodiment, the lubricating oil composition disclosed herein includes zinc dialkyl dithiophosphate (ZDDP) as the metal dialkyl dithiophosphate, the ZDDP comprising a primary ZDDP, a secondary ZDDP, or a combination thereof.

In a still further embodiment, the lubricating oil composition disclosed herein includes a metal dialkyl dithiophosphate present in an amount sufficient to provide a concentration of phosphorus ranging from 50 ppm to 300 ppm to the lubricant composition.

In another embodiment, the corrosion inhibitor comprises 1H-1,2,4-Triazole-1-methanamine, N,N-bis(2-ethylhexyl).

In yet another embodiment, the corrosion inhibitor is present in an amount sufficient to provide a concentration of nitrogen ranging from 0.75 ppm to 15 ppm to the lubricant composition.

In another embodiment, the lubricant composition is substantially free of (or in other embodiments free of) benzotriazole and benzotriazole derivative corrosion inhibitors. As used herein, substantially free of is 0.5 ppm or less of nitrogen, or 0.25 ppm or less of nitrogen, or 0.1 ppm or less of nitrogen from benzotriazole or benzotriazole derivative corrosion inhibitors, or in other embodiments, no functional amounts of benzotriazole or benzotriazole derivative corrosion inhibitors.

In another embodiment, the lubricant composition is substantially free of (or in other embodiments free of) tolytriazole and tolytriazole derivative corrosion inhibitors. As used herein, substantially free of is 0.5 ppm or less of nitrogen, or 0.25 ppm or less of nitrogen, or 0.1 ppm or less of nitrogen from tolytriazole or tolytriazole derivative corrosion inhibitors, or in other embodiments, no functional amounts of tolytriazole or tolytriazole derivative corrosion inhibitors.

In yet another embodiment, the lubricant composition has a copper weight loss in the hydrolytic stability test of 0.2 $mg/cm^2$ or less as measured according to ASTM D2619-21 over 96 hours.

In another embodiment, the lubricant composition herein has a Rotating Pressure Vessel Oxidation Test (RPVOT) value of at least 350 mins as measured according to ASTM D2272-22.

In another embodiment, the lubricant composition herein has a 4-ball wear value of less than 0.60 mm as measured according to ASTM D4172-21.

In still another embodiment, the lubricant composition herein further comprises a dispersant, a detergent, a friction modifier, or combinations thereof.

Another embodiment of the present disclosure includes a hydraulic system lubricated with a lubricating oil composition comprising a major amount of an oil of lubricating viscosity and an ashless dithiophosphate in an amount sufficient to provide a concentration of phosphorus ranging from 10 ppm to 250 ppm to the lubricant composition, a metal dialkyl dithiophosphate in an amount sufficient to provide a concentration of phosphorus ranging from 50 ppm to 1000 ppm to the lubricant composition, and a corrosion inhibitor comprising an alkyltriazole derivative in an amount sufficient to provide a concentration of nitrogen ranging from 0.75 ppm to 100 ppm to the lubricant composition.

Another embodiment includes a method for lubricating a hydraulic component wherein the hydraulic component is used in a vehicular application, a mobile application, e.g., construction equipment, i.e., wheel loaders, excavators, backhoes, bulldozers, graders, skid steers, articulated trucks, compact track loaders, or compactors, or an industrial application and wherein the hydraulic component is lubricated with a lubricating oil composition comprising a major amount of an oil of lubricating viscosity and an ashless dithiophosphate in an amount sufficient to provide a concentration of phosphorus ranging from 10 ppm to 250 ppm to the lubricant composition, a metal dialkyl dithiophosphate in an amount sufficient to provide a concentration of phosphorus ranging from 50 ppm to 1000 ppm to the lubricant composition, and a corrosion inhibitor comprising an alkyltriazole derivative in an amount sufficient to provide a concentration of nitrogen ranging from 0.75 ppm to 100 ppm to the lubricant composition. The metal dialkyl dithiophosphate may comprise (or be) zinc dialkyl dithiophosphate (ZDDP).

Other embodiments of the present disclosure will be apparent to those skilled in the art from consideration of the specification and examples disclosed herein.

DETAILED DESCRIPTION

Provided herein are lubricant compositions that can provide improved performance. The present disclosure relates to lubricant compositions that can combine hydraulic performance with corrosion resistance, oxidation resistance, and reduced wear for improved productivity.

In some cases, the lubricant compositions described herein can enable an extended service life in industrial and mobile applications, which can result in lower maintenance and operating costs. In some examples, the lubricant composition may be a hydraulic fluid composition. Some conventional hydraulic lubricants can have poor hydrolytic stability, experience high levels of wear, and/or fail to prevent or minimize corrosion and oxidation. The lubricant compositions described herein demonstrate extended durability and desirable properties such as hydrolytic stability, while providing excellent wear and oxidation protection.

Metallic Dialkyl Dithiophosphate

Described herein are lubricant compositions that may comprise a metal-containing dithiophosphate, e.g., a zinc dialkyl dithiophosphate in an amount sufficient to provide a concentration of phosphorus ranging from 50 to 1000 ppm to the lubricant composition.

In some examples, the metal dialkyl dithiophosphate may comprise (or be) zinc dialkyl dithiophosphate (ZDDP). In some examples, the zinc dialkyl dithiophosphate (ZDDP) may comprise (or be) a primary ZDDP, a secondary ZDDP, or a combination thereof. The ZDDP may have a chemical structure of formula (I):

(I)

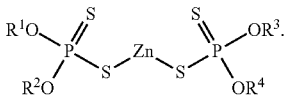

In some examples, $R^1$, $R^2$, $R^3$, and $R^4$ may each be independently an alkyl or cycloalkyl group comprising 1 to 18 carbon atoms. In some examples, $R^1$, $R^2$, $R^3$, and $R^4$ may each be independently an alkyl comprising 6 to 8 carbon atoms. Thus, the alkyl and/or cycloalkyl groups may be, for example, ethyl, n-propyl, i-propyl, n-butyl, i-butyl, sec-butyl, amyl, n-hexyl, i-hexyl, n-octyl, decyl, dodecyl, octadecyl, 2-ethylhexyl, cyclohexyl, methylcyclopentyl, propenyl, 4-methyl-2-pentyl (MIBC), or butenyl.

In some examples, the ZDDP may be present in an amount sufficient to provide a concentration of phosphorus ranging from 50 ppm to 1000 ppm to the lubricant composition (e.g., from 65 to 285 ppm, from 110 to 460 ppm, or from 80 to 930 ppm). The ZDDP may be present in an amount to provide a concentration of phosphorus of about 50, 55, 60, 65, 70, 80, 85, 90, 95, 100, 110, 120, 130, 140, 150, 160, 170, 180, 190, 200, 225, 250, 275, 300, 325, 350, 375, 400, 425, 450, 475, 500, 525, 550, 575, 600, 625, 650, 675, 700, 725, 750, 775, 800, 825, 850, 875, 900, 925, 950, 975, or 1000 ppm to the lubricant composition.

Ashless Dialkyl Dithiophosphate

Described herein are lubricant compositions that may comprise an ashless dithiophosphate in an amount sufficient to provide a concentration of phosphorus ranging from 10 ppm to 250 ppm to the lubricant composition.

In some examples, the ashless dithiophosphate may comprise a dithiophosphorylated carboxylic acid. The ashless dithiophosphate may have a chemical structure of formula (IIA) and/or tribologically acceptable salts thereof:

(IIA)

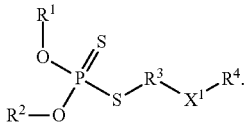

Each $R^1$ and $R^2$ may be independently a hydrocarbyl group comprising 1 to 20 carbon atoms. $R^3$ may be a divalent hydrocarbyl group comprising 1 to 20 carbon atoms. $X^1$ may be —C(O)O— or —O—. $R^4$ may be hydrogen or a hydrocarbyl group comprising 1 to 20 carbon atoms. Preferably, each $R^1$ and $R^2$ may independently comprise 1 to 12 carbon atoms, more preferably 1 to 8 carbon atoms. More preferably each $R^1$ and $R^2$ may independently comprise 2 to 6 carbon atoms. Preferred examples for $R^1$ and $R^2$ are alkyl groups such as methyl, ethyl, n-propyl, i-propyl, n-butyl, i-butyl, and t-butyl. The groups i-propyl and i-butyl may be particularly preferred. Preferably, $R^3$ may be a straight or branched alkylene group or an arylene (i.e. divalent aryl) group such as phenylene. Preferably, $R^3$ may be a straight or branched alkylene group. Preferably, $R^3$ may comprise 1 to 12 carbon atoms. More preferably, $R^3$ may comprise 1 to 8 carbon atoms, or 2 to 6 carbon atoms. Preferred examples for $R^3$ include alkylene groups such as —$CH_2$—, —$CH_2$—$CH_2$—, —$CH_2$—$CH_2$—$CH_2$—, —CH($CH_3$)—$CH_2$—, —$CH_2$—CH($CH_3$)—, $CH_2$—$CH_2$—$CH_2$—$CH_2$—, —CH($CH_3$)—$CH_2$—$CH_2$—, —$CH_2$—CH($CH_3$)—$CH_2$—, —$CH_2$—$CH_2$—CH($CH_3$)—, —CH($CH_3$)—CH($CH_3$)—, —C($CH_3$)$_2$—$CH_2$—, and —$CH_2$—C($CH_3$)$_2$—. Of these, groups containing 2 or 3 carbon atoms are preferred, in particular —$CH_2$—$CH_2$— and —$CH_2$—CH($CH_3$)—. $X^1$ is preferably —C(O)O—. When $R^4$ is a hydrocarbyl group containing 1 to 20 carbon atoms, it preferably comprises 1 to 12 carbon atoms, more preferably 1 to 8 carbon atoms, and yet more preferably 2 to 6 carbon atoms. Preferably, $R^4$ may be hydrogen, a straight or branched alkyl group, or an aryl group such as phenyl. More preferably $R^4$ may be hydrogen or a straight or branched alkyl group. When $R^4$ is a straight or branched alkyl group, preferred examples for $R^4$ include methyl, ethyl, n-propyl, i-propyl, n-butyl, i-butyl, and t-butyl. Ethyl, n-propyl, and i-propyl may be particularly preferred, and i-propyl most preferred. In some examples, each $R^1$ and $R^2$ may be independently an alkyl group comprising 2 to 6 carbon atoms, $R^3$ may be a divalent alkyl group comprising 2 to 6 carbon atoms, $X^1$ may be —C(O)O—, and $R^4$ may be hydrogen or an alkyl group comprising 2 to 6 carbon atoms.

In some examples, the ashless dithiophosphate may comprise (or be) 3-[[bis(2-methylpropoxy)phosphinothioyl]thio]-2-methyl-propanoic acid (CAS No.: 268567-32-4), ethyl 3-[[bis(1-methylethoxy)phosphinothioyl]thio]propionate (CAS No.: 71735-74-5), or a combination thereof. In some examples, the ashless dithiophosphate may have a chemical structure of formula (IIB):

(IIB)

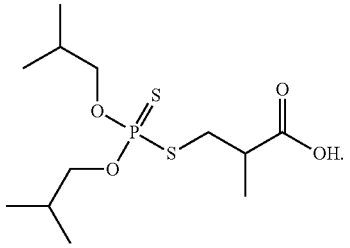

In some examples, the ashless dithiophosphate may have a chemical structure of formula (IIC):

(IIC)

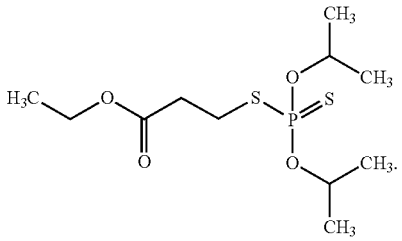

In some examples, the ashless dithiophosphate included in the composition may comprise component having a chemical structure of both formula (IIB) and formula (IIC), i.e., some amount of a component having chemical structure of formula (IIB) and some amount of a component having chemical structure of formula (IIC) may be present in the composition.

In some examples, the ashless dithiophosphate may provide a concentration of phosphorus ranging from 10 ppm to 250 ppm to the lubricant composition (e.g., from 10 to 40 ppm, from 12 to 155 ppm or from 18 to 210 ppm). For example, the ashless dithiophosphate may be present in an amount to provide a concentration of phosphorus of about 10, 11, 12, 13, 14, 15, 16, 17, 18, 19, 20, 25, 30, 35, 40, 45, 50, 60, 70, 80, 90, 100, 110, 120, 130, 140, 150, 160, 170, 180, 190, 200, 210, 220, 230, 240, or 250 ppm to the lubricant composition.

Corrosion Inhibitor

In some examples, the corrosion inhibitor may comprise (or be) 1H-1,2,4-Triazole-1-methanamine, N,N-bis(2-ethylhexyl). In some examples, the corrosion inhibitor comprising an alkyltriazole derivative may be present in an amount sufficient to provide a concentration of nitrogen ranging from 0.75 ppm to 100 ppm to the lubricant composition (e.g., from 0.75 to 15 ppm, from 3 to 48 ppm or from 8 to 92 ppm). The corrosion inhibitor comprising an alkyltriazole derivative may be present in an amount to provide a concentration of nitrogen of about 0.75, 0.8, 0.9, 1, 1.5, 2, 2.5, 3, 3.5, 4, 4.5, 5, 5.5, 6, 6.5, 7, 7.5, 8, 8.5, 9, 9.5, 10, 11, 12, 13, 14, 15, 20, 25, 30, 35, 40, 45, 50, 55, 60, 65, 70, 75, 80, 85, 90, 95, or 100 ppm to the lubricant composition. In some examples, the corrosion inhibitor may be substantially free of (and in other embodiments free of) benzotriazole and benzotriazole derivatives. The corrosion inhibitor may be substantially free of (and in other embodiments free of) tolytriazole and/or tolytriazole derivatives. In some examples, the corrosion inhibitor may have a chemical structure of formula (III):

(III)

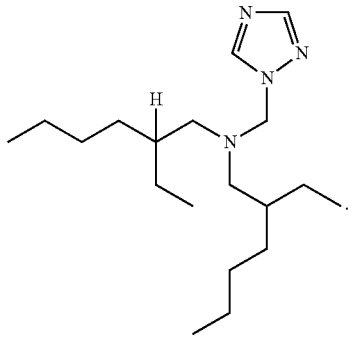

In some examples, the corrosion inhibitor may be substantially free of (and in other embodiments free of) components having a chemical structure of formula (IV):

(IV)

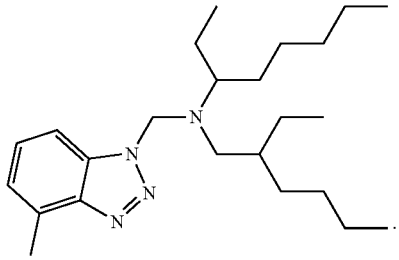

In some examples, the corrosion inhibitor may be substantially free of (and in other embodiments free of) components having a chemical structure of formula (V):

(V)

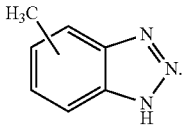

In some examples, the corrosion inhibitor may be substantially free of (and in other embodiments free of) components having a chemical structure of formula (IV) and formula (V).

As used herein, substantially free of, unless the context suggests otherwise, refers to about 0.5 ppm or less of nitrogen, or 0.25 ppm or less of nitrogen, or 0.1 ppm or less of nitrogen from benzotriazole or benzotriazole derivative corrosion inhibitors, or tolyltriazole or tolytriazole derivative corrosion inhibitors, or components having a chemical structure of formula (IV), formula (V), or combinations thereof as the case may be for each type of corrosion inhibitor. In yet other embodiments, substantially free of includes no functional amounts of benzotriazole or benzotriazole derivative corrosion inhibitors, or tolyltriazole or tolytriazole derivative corrosion inhibitors, or components having a chemical structure of formula (IV), formula (V), or combinations thereof as the case may be for each type of corrosion inhibitor.

Base Oil

The lubricating compositions herein may be driveline or industrial lubricating compositions and may include one or more base oils having a lubricating viscosity. Base oils suitable for use in formulating the lubricating compositions according to the disclosure may be selected from any of suitable synthetic or natural oils or mixtures thereof having a suitable lubricating viscosity. Natural oils may include animal oils and vegetable oils (e.g., castor oil, lard oil) as well as mineral oils such as liquid petroleum oils and solvent treated or acid-treated mineral lubricating oils of the paraffinic, naphthenic or mixed paraffinic-naphthenic types. Oils derived from coal or shale may also be suitable. Further, oil derived from a gas-to-liquid process is also suitable. The base oil may have a kinematic viscosity at 100° C. of about 2 to about 15 cSt, as measured by ASTM D2270-10.

The base oil as used in the lubricating compositions described herein may be a single base oil or may be a mixture of two or more base oils selected from API Groups I to V. In one embodiment, the one or more base oil(s) may be selected from any of the base oils in Groups III and/or IV as specified in the American Petroleum Institute (API) Base Oil Interchangeability Guidelines. Such base oil groups are shown in Table 1 as follows:

TABLE 1

| Base oil Category | Sulfur (%) | | Saturates (%) | Viscosity Index |
|---|---|---|---|---|
| API Group I | >0.03 | and/or | <90 | 80 to 120 |
| API Group II | ≤0.03 | and | ≥90 | 80 to 120 |
| API Group III | ≤0.03 | and | ≥90 | ≥120 |
| API Group IV | All polyalphaolefins (PAOs) | | | |
| API Group V | All others not included in Groups I, II, III, or IV | | | |

API Group III base oils may include oil derived from Fischer-Tropsch synthesized hydrocarbons. Fischer-Tropsch synthesized hydrocarbons are made from synthesis gas containing $H_2$ and CO using a Fischer-Tropsch catalyst. Such hydrocarbons typically require further processing in order to be useful as the base oil. These types of oils are commonly referred to as gas-to-liquids (GTLs). For example, the hydrocarbons may be hydroisomerized using processes disclosed in U.S. Pat. No. 6,103,099 or 6,180,575; hydrocracked and hydroisomerized using processes disclosed in U.S. Pat. No. 4,943,672 or 6,096,940; dewaxed using processes disclosed in U.S. Pat. No. 5,882,505; or hydroisomerized and dewaxed using processes disclosed in U.S. Pat. Nos. 6,013,171; 6,080,301; or 6,165,949.

API Group IV base oils, PAOs, are typically derived from monomers having from 4 to 30, or from 4 to 20, or from 6 to 16 carbon atoms. Examples of PAOs that may be used in the lubricant compositions described herein include those derived from octene, decene, mixtures thereof, and the like. PAOs may have a kinematic viscosity of from 2 to 15, or from 3 to 12, or from 4 to 8 cSt at 100° C., as measured by ASTM D2270-10. Examples of PAOs include 4 cSt at 100° C. PAOs, 6 cSt at 100° C. PAOs, and mixtures thereof.

The base oil(s) may be combined with an additive composition as disclosed in embodiments herein to provide a lubricating composition for use in a hydraulic system. The base oil may be present in the lubricating composition in an amount greater than about 80 wt. % based on the total weight of the lubricating composition. In some embodiments, the base oil may be present in the lubricating composition in an amount greater than about 85 wt. % based on the total weight of the lubricating composition.

Other Additives

The lubricating compositions described herein may also include other additives of the type used in hydraulic fluid compositions in addition to the components described above. Such additives include, but are not limited to, antioxidant(s), viscosity modifier(s), phosphorus-containing component(s), detergent(s), antirust additive(s), antifoam agent(s), demulsifier(s), pour point depressant(s), seal swell agent(s), dispersant(s), and/or sulfur-containing component (s) as needed for a particular application.

Antioxidants

In some embodiments, the lubricating compositions may comprise one or more antioxidants. Suitable antioxidants include phenolic antioxidants, aromatic amine antioxidants, sulfur containing antioxidants, and organic phosphites, among others.

Examples of phenolic antioxidants include 2,6-di-tert-butylphenol, liquid mixtures of tertiary butylated phenols, 2,6-di-tert-butyl-4-methylphenol, 4,4'-methylenebis(2,6-di-tert-butylphenol), 2,2'-methylenebis(4-methyl-6-ter-t-butylphenol), and mixed methylene-bridged polyalkyl phenols, and 4,4'-thiobis(2-methyl-6-tert-butylphenol), N,N'-di-sec-butyl-phenylenediamine, 4-iisopropylaminodiphenylamine, phenyl-alpha-naphthyl amine, phenyl-alpha-naphthyl amine, and ring-alkylated diphenylamines. Examples include the sterically hindered tertiary butylated phenols, bisphenols and cinnamic acid derivatives and combinations thereof.

Aromatic amine antioxidants include, but are not limited to diarylamines having the formula (VI):

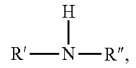

(VI)

wherein R' and R" each independently represents a substituted or unsubstituted aryl group having from 6 to 30 carbon atoms. Illustrative of substituents for the aryl group include aliphatic hydrocarbon groups such as alkyl having from 1 to 30 carbon atoms, hydroxy groups, halogen radicals, carboxylic acid or ester groups, or nitro groups.

The aryl group is preferably substituted or unsubstituted phenyl or naphthyl, particularly wherein one or both of the aryl groups are substituted with at least one alkyl having from 4 to 30 carbon atoms, preferably from 4 to 18 carbon atoms, most preferably from 4 to 9 carbon atoms. It is preferred that one or both aryl groups be substituted, e.g. mono-alkylated diphenylamine, di-alkylated diphenylamine, or mixtures of mono- and di-alkylated diphenylamines.

Examples of diarylamines that may be used include, but are not limited to: diphenylamine; various alkylated diphenylamines, 3-hydroxydiphenylamine, N-phenyl-1,2-phenylenediamine, N-phenyl-1,4-phenylenediamine, monobutyldiphenyl-amine, dibutyldiphenylamine, monooctyldiphenylamine, dioctyldiphenylamine, monononyldiphenylamine, dinonyldiphenylamine, monotetradecyldiphenylamine, ditetradecyldiphenylamine, phenyl-alpha-naphthylamine, monooctyl phenyl-alpha-naphthylamine, phenyl-beta-naphthylamine, monoheptyldiphenylamine, diheptyl-diphenylamine, p-oriented styrenated diphenylamine, mixed butyloctyldi-phenylamine, and mixed octylstyryldiphenylaminc.

The sulfur containing antioxidants include, but are not limited to, sulfurized olefins that are characterized by the type of olefin used in their production and the final sulfur content of the antioxidant. High molecular weight olefins, i.e., those olefins having an average molecular weight of 168 to 351 g/mole, are preferred. Examples of olefins that may be used include alpha-olefins, isomerized alpha-olefins, branched olefins, cyclic olefins, and combinations of these.

Alpha-olefins include, but are not limited to, any $C_4$ to $C_{25}$ alpha-olefins. Alpha-olefins may be isomerized before the sulfurization reaction or during the sulfurization reaction. Structural and/or conformational isomers of the alpha olefin that contain internal double bonds and/or branching may also be used. For example, isobutylene is a branched olefin counterpart of the alpha-olefin 1-butene.

Sulfur sources that may be used in the sulfurization reaction of olefins include: elemental sulfur, sulfur monochloride, sulfur dichloride, sodium sulfide, sodium polysulfide, and mixtures of these added together or at different stages of the sulfurization process.

Unsaturated oils, because of their unsaturation, may also be sulfurized and used as an antioxidant. Examples of oils or fats that may be used include corn oil, canola oil, cottonseed oil, grapeseed oil, olive oil, palm oil, peanut oil, coconut oil, rapeseed oil, safflower seed oil, sesame seed oil, soybean oil, sunflower seed oil, tallow, and combinations of these.

The total amount of antioxidant in the lubricating compositions described herein may be from 500 ppm to 25,000 ppm. The lower limit may preferably be e.g. 600 ppm, 700 ppm, 800 ppm, 900 ppm, or 1000 ppm. The upper limit may preferably be e.g. 20,000 ppm, 15,000 ppm, 10,000 ppm, or 5,000 ppm. Typical preferred concentration ranges are e.g. 800 to 15,000 ppm, 900 to 10,000 ppm, or 1,000 to 5,000 ppm. When the composition comprises one or more nitrogen-containing antioxidants (e.g. aromatic amines), said one or more antioxidants may be present in an amount to deliver up to about 200 ppm nitrogen, or up to about 150 ppm nitrogen, or about 100 to about 150 ppm nitrogen.

Detergents

Metal detergents that may be included in the lubricating compositions described herein may generally comprise a polar head with a long hydrophobic tail where the polar head comprises a metal salt of an acidic organic compound. The salts may contain a substantially stoichiometric amount of the metal, in which case they are usually described as normal or neutral salts, and would typically have a total base number or TBN (as measured by ASTM D2896) of from 0 to less than 150. Large amounts of a metal base may be included by reacting an excess of a metal compound such as an oxide or hydroxide with an acidic gas such as carbon dioxide. The resulting overbased detergent comprises micelles of neutralized detergent surrounding a core of inorganic metal base (e.g., hydrated carbonates). Such overbased detergents may have a TBN of 150 or greater, such as from 150 to 450 or more.

Detergents that may be suitable for use in the present embodiments include oil-soluble overbased, low base, and neutral sulfonates, phenates, sulfurized phenates, and salicylates of a metal, particularly the alkali or alkaline earth metals, e.g., sodium, potassium, lithium, calcium, and magnesium. More than one metal may be present, for example, both calcium and magnesium. Mixtures of calcium and/or magnesium with sodium may also be suitable. Suitable metal detergents may be overbased calcium or magnesium sulfonates having a TBN of from 150 to 450 TBN, overbased calcium or magnesium phenates or sulfurized phenates having a TBN of from 150 to 300 TBN, and overbased calcium or magnesium salicylates having a TBN of from 130 to 350. Mixtures of such salts may also be used.

The metal-containing detergent may be present in the fluid in an amount sufficient to provide up to 500 ppm alkali and/or alkaline earth metal based on a total weight of the lubricating composition. In one example, the metal-containing detergent may be present in an amount sufficient to provide about 50 to about 500 ppm alkali and/or alkaline earth metal. In another embodiment, the metal-containing detergent may be present in an amount sufficient to provide from about 100 to about 400 ppm alkali and/or alkaline earth metal. In one approach, preferred detergents may be neutral, low-based, or overbased sulfonates, and in some approaches, overbased calcium sulfonates. Suitable detergents may be calcium sulfonates having a TBN of 250 or more (such as about 250 to about 450 or 280 to 400) and providing more than about 50 ppm of calcium to the lubricant. In other approaches, the detergents may provide about 50 to about 500 ppm of calcium, about 100 to about 400 ppm of calcium, or about 100 to about 300 ppm of calcium, or about 100 to about 200 ppm calcium to the lubricating compositions herein.

Dispersants

The lubricating composition may include one or more select dispersants or mixtures thereof. Dispersants are often known as ashless-type dispersants because, prior to mixing in a lubricating oil composition, they do not contain ash-forming metals and they do not normally contribute any ash when added to a lubricant. Ashless-type dispersants are characterized by a polar group attached to a relatively high molecular weight hydrocarbon chain. Typical ashless dispersants include N-substituted long chain alkenyl succinimides. N-substituted long chain alkenyl succinimides include polyisobutylene (PIB) substituents with a number average molecular weight of the polyisobutylene substituent in a range of about 800 to about 2500 as determined by gel permeation chromatography (GPC) using polystyrene (with a number average molecular weight of 180 to about 18,000) as the calibration reference. The PIB substituent used in the dispersant typically has a viscosity at 100° C. of about 2100 to about 2700 cSt as determined using ASTM D445-18. Succinimide dispersants and their preparation are disclosed, for instance in U.S. Pat. Nos. 7,897,696 and 4,234,435 which are incorporated herein by reference. Succinimide dispersants are typically an imide formed from a polyamine, typically a poly(ethyleneamine). The dispersants may include two succinimide moieties joined by a polyamine. The polyamine may be tetra ethylene penta amine (TEPA), tri ethylene tetra amine (TETA), penta ethylene hexa amine (PEHA), other higher nitrogen ethylene diamine species and/or mixtures thereof. The polyamines may be mixtures of linear, branched and cyclic amines. The PIB substituents may be joined to each succinimide moiety.

In some embodiments, the lubricant composition comprises at least one polyisobutylene succinimide dispersant derived from polyisobutylene with number average molecular weight in the range about 350 to about 5000, or about 500 to about 3000, as measured by the GPC method described above. The polyisobutylene succinimide may be used alone or in combination with other dispersants.

In some embodiments, polyisobutylene (PIB), when included, may have greater than 50 mol. %, greater than 60 mol. %, greater than 70 mol. %, greater than 80 mol. %, or greater than 90 mol. % content of terminal double bonds. Such a PIB is also referred to as highly reactive PIB ("HR-PIB"). HR-PIB having a number average molecular weight ranging from about 800 to about 5000 is suitable for use in embodiments of the present disclosure. Conventional non-highly reactive PIB typically has less than 50 mol. %, less than 40 mol. %, less than 30 mol. %, less than 20 mol. %, or less than 10 mol. % content of terminal double bonds.

An HR-PIB having a number average molecular weight ranging from about 900 to about 3000, as measured by the GPC method described above, may be suitable. Such an HR-PIB is commercially available, or can be synthesized by the polymerization of isobutene in the presence of a non-chlorinated catalyst such as boron trifluoride, as described in U.S. Pat. Nos. 4,152,499 and 5,739,355. When used in the thermal ene reaction, HR-PIB may lead to higher conversion rates in the reaction, as well as lower amounts of sediment formation, due to increased reactivity.

In some embodiments, the lubricant composition comprises at least one dispersant derived from polyisobutylene succinic anhydride. In an embodiment, the dispersant may be derived from a polyalphaolefin (PAO) succinic anhydride. In an embodiment, the dispersant may be derived from olefin maleic anhydride copolymer. As an example, the dispersant may be described as a poly-PIBSA. In an embodiment, the dispersant may be derived from an anhydride which is grafted to an ethylene-propylene copolymer.

One class of suitable dispersants may be Mannich bases. Mannich bases are materials that are formed by the condensation of a higher molecular weight, alkyl substituted phenol, a polyalkylene polyamine, and an aldehyde such as formaldehyde. Mannich bases are described in more detail in U.S. Pat. No. 3,634,515.

A suitable class of dispersants may be high molecular weight esters or half ester amides. The dispersants may also be post-treated by conventional methods by reaction with any of a variety of agents. Among these agents are boron, urea, thiourea, dimercaptothiadiazoles, carbon disulfide, aldehydes, ketones, carboxylic acids, hydrocarbon-substituted succinic anhydrides, maleic anhydride, nitriles, epoxides, carbonates, cyclic carbonates, hindered phenolic esters, and phosphorus compounds. U.S. Pat. Nos. 7,645,726; 7,214,649; and 8,048,831 describe some suitable post-treatment methods and post-treated products.

Suitable boron compounds useful in forming the dispersants herein include any boron compound or mixtures of boron compounds capable of introducing boron-containing species into the ashless dispersant. Any boron compound, organic or inorganic, capable of undergoing such reaction can be used. Accordingly, use can be made of boron oxide, boron oxide hydrate, boron trifluoride, boron tribromide, boron trichloride, $HBF_4$ boron acids such as boronic acid (e.g. alkyl-$B(OH)_2$ or aryl-$B(OH)_2$), boric acid, (i.e., $H_3BO_3$), tetraboric acid (i.e., $H_2B_{507}$), metaboric acid (i.e., $HBO_2$), ammonium salts of such boron acids, and esters of such boron acids. The use of complexes of a boron trihalide with ethers, organic acids, inorganic acids, or hydrocarbons is a convenient means of introducing the boron reactant into the reaction mixture. Such complexes are known and are exemplified by boron trifluoride-diethyl ether, boron trifluoride-phenol, boron trifluoride-phosphoric acid, boron trichloride-chloroacetic acid, boron tribromide-dioxane, and boron trifluoride-methyl ethyl ether.

Suitable phosphorus compounds for forming the dispersants herein include phosphorus compounds or mixtures of phosphorus compounds capable of introducing a phosphorus-containing species into the ashless dispersant. Any phosphorus compound, organic or inorganic, capable of undergoing such reaction can thus be used. Accordingly, use can be made of such inorganic phosphorus compounds as the inorganic phosphorus acids, and the inorganic phosphorus oxides, including their hydrates. Typical organic phosphorus compounds include full and partial esters of phosphorus acids, such as the mono-, di-, and tri esters of phosphoric acid, thiophosphoric acid, dithiophosphoric acid, trithiophosphoric acid and tetrathiophosphoric acid; the mono-, di-, and tri esters of phosphorous acid, thiophosphorous acid, dithiophosphorous acid and trithiophosphorous acid; the trihydrocarbyl phosphine oxides: the trihydrocarbyl phosphine sulfides; the mono- and dihydrocarbyl phosphonates, (RPO(OR')(OR") where R and R' are hydrocarbyl and R" is a hydrogen atom or a hydrocarbyl group), and their mono-, di- and trithio analogs; the mono- and dihydrocarbyl phosphonites, (RP(OR')(OR") where R and R' are hydrocarbyl and R" is a hydrogen atom or a hydrocarbyl group) and their mono- and dithio analogs; and the like. Thus, use can be made of such compounds as, for example, phosphorous acid ($H_3PO_3$, sometimes depicted as $H_2$ ($HPO_3$), and sometimes called ortho-phosphorous acid or phosphonic acid), phosphoric acid ($H_3PO_4$, sometimes called orthophosphoric acid), hypophosphoric acid ($H_4P_2O_6$), metaphosphoric acid ($HPO_3$), pyrophosphoric acid ($H_4P_2O_7$), hypophosphorous acid ($H_3PO_2$, sometimes called phosphinic acid), pyrophosphorous acid ($H_4P_2O_5$, sometimes called pyrophosphonic acid), phosphinous acid ($H_3PO$), tripolyphosphoric acid ($H_5P_3O_{10}$, tetrapolyphosphoric acid ($H_5P_4O_{13}$), trimetaphosphoric acid ($H_3P_3O_9$), phosphorus trioxide, phosphorus tetraoxide, phosphorus pentoxide, and the like. Partial or total sulfur analogs such as phosphorotetrathioic acid ($H_3PS_4$), phosphoromonothioic acid ($H_3PO_3S$), phosphorodithioic acid ($H_3PO_2S_2$), phosphorotrithioic acid ($H_3POS_3$), phosphorus sesquisulfide, phosphorus heptasulfide, and phosphorus pentasulfide ($P_2S_5$, sometimes referred to as $P_4S_{10}$) can also be used in forming dispersants for this disclosure. Also usable are the inorganic phosphorus halide compounds such as $PCl_3$, $PBr_3$, $POCl_3$, $PSCl_3$, etc.

Likewise use can be made of such organic phosphorus compounds as mono-, di-, and triesters of phosphoric acid (e.g., trihydrocarbyl phosphates, dihydrocarbyl monoacid phosphates, monohydrocarbyl diacid phosphates, and mixtures thereof), mono-, di-, and triesters of phosphorous acid (e.g., trihydrocarbyl phosphites, dihydrocarbyl hydrogen phosphites, hydrocarbyl diacid phosphites, and mixtures thereof), esters of phosphonic acids (both "primary", $RP(O)(OR)_2$, and "secondary", $R_2P(O)(OR)$), esters of phosphinic acids, phosphonyl halides (e.g., $RP(O)Cl_2$ and $R_2P(O)Cl$), halophosphites (e.g., $(RO)PCl_2$ and $(RO)_2PCl$), halophosphates (e.g., $ROP(O)Cl_2$ and $(RO)_2P(O)Cl$), tertiary pyrophosphate esters (e.g., $(RO)_2P(O)—O—P(O)(OR)_2$), and the total or partial sulfur analogs of any of the foregoing organic phosphorus compounds, and the like wherein each hydrocarbyl group contains up to about 100 carbon atoms, or up to about 50 carbon atoms, or up to about 24 carbon atoms, or up to about 12 carbon atoms. Also usable are the halophosphine halides (e.g., hydrocarbyl phosphorus tetrahalides, dihydrocarbyl phosphorus trihalides, and trihydrocarbyl phosphorus dihalides), and the halophosphines (monohalophosphines and dihalophosphines).

The lubricants herein may include mixtures of one or more boronated and phosphorylated dispersants set forth above combined with non-boronated and non-phosphorylated dispersants.

In one embodiment, the lubricating compositions may include at least one borated dispersant, wherein the dispersant is the reaction product of an olefin copolymer or a reaction product of an olefin copolymer with succinic anhydride, and at least one polyamine. The ratio of PIBSA: polyamine may be from 1:1 to 10:1, or 1:1 to 5:1, or 4:3 to 3:1, or 4:3 to 2:1. A particularly useful dispersant contains a polyisobutenyl group of the PIBSA having a number average molecular weight (Mn) in the range of from about 500 to 5000, as determined by the GPC method described above, and a (B) polyamine having a general formula $H_2N(CH_2)_m$—$[NH(CH_2)_m]_n$—$NH_2$, wherein m is in the range from 2 to 4 and n is in the range of from 1 to 2.

In addition to the above, the dispersant may be post-treated with an aromatic carboxylic acid, an aromatic polycarboxylic acid, or an aromatic anhydride wherein all carboxylic acid or anhydride group(s) are attached directly to an aromatic ring. Such carboxyl-containing aromatic compounds may be selected from 1,8-naphthalic acid or anhydride and 1,2-naphthalenedicarboxylic acid or anhydride, 2,3-naphthalenedicarboxylic acid or anhydride, naphthalene-1,4-dicarboxylic acid, naphthalene-2,6-dicarboxylic acid, phthalic anhydride, pyromellitic anhydride, 1,2,4-benzene tricarboxylic acid anhydride, diphenic acid or anhydride, 2,3-pyridine dicarboxylic acid or anhydride, 3,4-pyridine dicarboxylic acid or anhydride, 1,4,5,8-naphthalenetetracarboxylic acid or anhydride, perylene-3,4,9,10-tetracarboxylic anhydride, pyrene dicarboxylic acid or anhydride, and the like. The moles of this post-treatment component reacted per mole of the polyamine may range from about 0.1:1 to about 2:1. A typical molar ratio of this post-treatment component to polyamine in the reaction mixture may range from about 0.2:1 to about 2:1. Another molar ratio of this post-treatment component to the polyamine that may be used may range from 0.25:1 to about 1.5:1. This post-treatment component may be reacted with the other components at a temperature ranging from about 140° C. to about 180° C.

Alternatively, or in addition to the post-treatment described above, the dispersant may be post-treated with a non-aromatic dicarboxylic acid or anhydride. The non-aromatic dicarboxylic acid or anhydride of may have a number average molecular weight of less than 500, as measured by the GPC method described above. Suitable carboxylic acids or anhydrides thereof may include, but are not limited to acetic acid or anhydride, oxalic acid and anhydride, malonic acid and anhydride, succinic acid and anhydride, alkenyl succinic acid and anhydride, glutaric acid and anhydride, adipic acid and anhydride, pimelic acid and anhydride, suberic acid and anhydride, azelaic acid and anhydride, sebacic acid and anhydride, maleic acid and anhydride, fumaric acid and anhydride, tartaric acid and anhydride, glycolic acid and anhydride, 1,2,3,6-tetrahydronaphthalic acid and anhydride, and the like.

The non-aromatic carboxylic acid or anhydride is reacted at a molar ratio with the polyamine ranging from about 0.1 to about 2.5 moles per mole of polyamine. Typically, the amount of non-aromatic carboxylic acid or anhydride used will be relative to the number of secondary amino groups in the polyamine. Accordingly, from about 0.2 to about 2.0 moles of the non-aromatic carboxylic acid or anhydride per secondary amino group in Component B may be reacted with the other components to provide the dispersant according to embodiments of the disclosure. Another molar ratio of the non-aromatic carboxylic acid or anhydride to polyamine that may be used may range from 0.25:1 to about 1.5:1 moles of per mole of polyamine. The non-aromatic carboxylic acid or anhydride may be reacted with the other components at a temperature ranging from about 140° C. to about 180° C.

The weight % actives of the alkenyl or alkyl succinic anhydride can be determined using a chromatographic technique. This method is described in column 5 and 6 in U.S. Pat. No. 5,334,321. The percent conversion of the polyolefin is calculated from the % actives using the equation in column 5 and 6 in U.S. Pat. No. 5,334,321.

The TBN of a suitable borated dispersant may be from about 10 to about 65 mg KOH/gram composition on an oil-free basis, which is comparable to about 5 to about 30 mg KOH/gram composition TBN if measured on a dispersant sample containing about 50% diluent oil.

Typically, the dispersants described above are provided in about 1 to about 15 wt. % and, in other approaches, about 1.5 to about 8 wt. %, and in yet other approaches, about 2 to about 6 wt. % in the lubricant.

Viscosity Modifiers

The lubricating compositions may optionally contain one or more viscosity modifiers. Suitable viscosity modifiers may include polyolefins, olefin copolymers, ethylene/propylene copolymers, polyisobutenes, hydrogenated styrene-isoprene polymers, styrene/maleic ester copolymers, hydrogenated styrene/butadiene copolymers, hydrogenated isoprene polymers, alpha-olefin maleic anhydride copolymers, polymethacrylates, polyacrylates, polyalkyl styrenes, hydrogenated alkenyl aryl conjugated diene copolymers, or mixtures thereof. Viscosity modifiers may include star polymers and suitable examples are described in US Publication No. 2012/0101017 A1.

The lubricating compositions described herein also may optionally contain one or more dispersant viscosity modifiers in addition to a viscosity modifier or in lieu of a viscosity modifier. Suitable dispersant viscosity modifiers may include functionalized polyolefins, for example, ethylene-propylene copolymers that have been functionalized with the reaction product of an acylating agent (such as maleic anhydride) and an amine; polymethacrylates functionalized with an amine, or esterified maleic anhydride-styrene copolymers reacted with an amine.

The total amount of viscosity modifier and/or dispersant viscosity modifier, when present, may be up to about 2.0 wt. %, or up to about 1.0 wt. %, or up to about 0.5 wt. %, or up to about 0.3 wt. % based on the total weight of the lubricating compositions.

Demulsifiers

Demulsifiers include trialkyl phosphates, and various polymers and copolymers of ethylene glycol, ethylene oxide, propylene oxide, or mixtures thereof, including polyethylene oxides, polypropylene oxides and (ethylene oxide-propylene oxide) polymers. When present, the amount of demulsifier in the lubricating compositions may be up about 0.05 wt. %, or up to about 0.02 wt. %, or below about 0.015 wt. % based on the total weight of the lubricating compositions.

Antifoam Agents

Antifoam agents used to reduce or prevent the formation of stable foam include silicones, polyacrylates, or organic polymers. Foam inhibitors that may be useful in the disclosed compositions include polysiloxanes, copolymers of ethyl acrylate and 2-ethylhexylacrylate and optionally vinyl acetate. When present, the amount of antifoam in the lubricating compositions may be up about 0.1 wt. %, or up to about 0.05 wt. %, or below about 0.04 wt. % based on the total weight of the lubricating compositions.

In general terms, lubricating compositions described herein may include additive components in the ranges listed in Table 2.

TABLE 2

| Component | Wt. % |
|---|---|
| Corrosion Inhibitor | 0-1 |
| Detergent(s) | 0.05-0.5 |
| Dispersant(s) | 0.1-2 |
| Sulfurized component(s) | 0.05-1.5 |
| Antiwear additive(s) | 0.01-1.5 |
| Antioxidant(s) | 0.05-0.6 |
| Antifoaming Agent(s) | 0-0.05 |
| Viscosity index improver(s) | 0-10 |
| Base oil | Balance |
| Total | 100 |

In some cases, the lubricating compositions can comprise a corrosion inhibitor in an amount of 0.04 to 0.5 wt. %; detergent(s) in an amount of 0.08 to 0.3 wt. %; dispersant(s) in an amount of 0.15 to 1 wt. %; sulfurized component(s) in an amount of 0.2 to 1 wt. %; antiwear additive(s) in an amount of 0.05 to 0.5 wt. %; antioxidant(s) in an amount of 0.1 to 0.5 wt. %; antifoaming agent(s) in an amount of 0.01 to 0.04 wt. %; viscosity index improver(s) in an amount of 0 to 5 wt. %; and a balance of base oil, all wt. % based on the total weight of the lubricating composition.

The percentages of each component above represent the weight percent of each component, based upon the total weight of the lubricating compositions containing the recited component. Additives used in formulating the compositions described herein may be blended into the base oil individually or in various sub-combinations. However, it may be suitable to blend all of the components concurrently using an additive concentrate (i.e., additives plus a diluent, such as a hydrocarbon solvent). The use of an additive concentrate takes advantage of the mutual compatibility afforded by the combination of ingredients when in the form of an additive concentrate. Also, the use of a concentrate reduces blending time and lessens the possibility of blending errors.

The lubricant compositions described herein may have a copper weight loss in the hydrolytic stability test of 0.2 $mg/cm^2$ or less as measured according to ASTM D2619-21 over 96 hours, (e.g., 0.03 $mg/cm^2$, 0.09 $mg/cm^2$, or 0.15 $mg/cm^2$). The hydrolytic stability loss may be less than 0.2, 0.19, 0.18, 0.17, 0.16, 0.15, 0.14, 0.13, 0.12, 0.11, 0.1, 0.09, 0.08, 0.07, 0.06, 0.05, 0.04, 0.03, 0.02, or 0.01 $mg/cm^2$ according to ASTM D2619-21 over 96 hours. This test method can differentiate the relative stability of lubricants in the presence of water. Hydrolytically unstable lubricants can form acidic and insoluble contaminants which may cause hydraulic system malfunctions due to corrosion, valve sticking, or change in viscosity of the fluid.

The lubricant compositions described herein may have a Rotating Pressure Vessel Oxidation Test (RPVOT) value of at least 350 mins as measured according to ASTM D2272-22 (e.g., 352 mins, 438 min, or 506 min). The RPVOT value may be at least 350, 355, 360, 365, 370, 375, 380, 385, 390, 395, 400, 405, 410, 415, 420, 425, 430, 435, 440, 445, 450, 455, 460, 465, 470, 475, 480, 485, 490, 495, 500, 505, 510, 515, 520, or 525 mins according to ASTM D2619-21 over 96 hours. RPVOT may provide an estimate of the oxidation stability of a lubricant.

The lubricant compositions described herein may have a 4-ball wear value of less than 0.6 mm as measured according to ASTM D4172-21 (e.g., 0.58 mm, 0.52 mm, or 0.48 mm). The 4-ball wear value may be less than about 0.6, 0.59, 0.58, 0.57, 0.56, 0.55, 0.54, 0.53, 0.52, 0.51, 0.5, 0.49, 0.48, 0.47, 0.46, or 0.45 mm according to ASTM D4172-21. This test method can determine the relative anti-wear properties of a lubricating fluid in sliding contact by means of the Four-Ball Wear Test Machine.

Methods and Systems of Use

Also disclosed herein are methods for using a lubricant composition. In some examples, the lubricant composition may be in a chamber of a hydraulic system. Non-limiting examples of hydraulic systems include mobile applications such as construction equipment including wheel loaders, excavators, backhoes, bulldozers, graders, skid steers, articulated trucks, compact track loaders, or compactors. Other non-limiting examples of hydraulic systems include parts and components for vehicular and industrial applications, such as off-shore oil and gas, cement manufacturing, off-road, assembly plant, sub-sea hydraulics, pulp and paper, glass, dockyards, food processing, marine, power generation, rubber and plastics, or metal manufacturing.

Also disclosed herein are methods for lubricating a hydraulic component. Examples of suitable components may include hydraulic systems used in construction equipment, off-shore oil and gas equipment, cement manufacturing equipment, off-road equipment, assembly plant equipment, sub-sea hydraulics, pulp and paper equipment, glass equipment, dockyards, food processing equipment, marine equipment, power generation equipment, rubber and plastics equipment, or metal manufacturing equipment. A method for lubricating a hydraulic component may comprise lubricating the component with a lubricant comprising an ashless dithiophosphate, a metal dialkyl dithiophosphate, a corrosion inhibitor comprising an alkyltriazole derivative, and a major amount of a base oil. The lubricant may comprise ashless dithiophosphate in an amount sufficient to provide a concentration of phosphorus ranging from 9 ppm to 40 ppm to the lubricant composition. The metal dialkyl dithiophosphate may comprise (or be) zinc dialkyl dithiophosphate (ZDDP). The lubricant may comprise ZDDP or other suitable metal dialkyl dithiophosphate in an amount sufficient to provide a concentration of phosphorus ranging from 65 ppm to 285 ppm to the lubricant composition. The lubricant may comprise the corrosion inhibitor in an amount sufficient to provide a concentration of nitrogen ranging from 0.75 ppm to 15 ppm to the lubricant composition. In some examples, the method may comprise lubricating equipment used in a vehicular application, a mobile application, or an industrial application.

Definitions

The following definitions of terms are provided in order to clarify the meanings of certain terms as used herein.

The terms "lubricating oil," "lubricant composition," "lubricating composition," "lubricant" and "driveline lubricating composition" refer to a finished lubrication product comprising a major amount of a base oil plus a minor amount of an additive composition.

As used herein, the terms "additive package," "additive concentrate," and "additive composition," refer the portion of the lubricating oil composition excluding the major amount of base oil.

As used herein, the term "hydrocarbyl substituent" or "hydrocarbyl group" is used in its ordinary sense, which is well-known to those skilled in the art. Specifically, it refers to a group having a carbon atom directly attached to the remainder of the molecule and having a predominantly hydrocarbon character. Each hydrocarbyl group is independently selected from hydrocarbon substituents, and substituted hydrocarbon substituents containing one or more of halo groups, hydroxyl groups, alkoxy groups, mercapto groups, nitro groups, nitroso groups, amino groups, pyridyl groups, furyl groups, imidazolyl groups, oxygen and nitrogen, and wherein no more than two non-hydrocarbon substituents are present for every ten carbon atoms in the hydrocarbyl group.

As used herein, the term "percent by weight" or "wt. %", unless expressly stated otherwise, means the percentage the recited component represents to the weight of the entire composition.

The terms "soluble," "oil-soluble," or "dispersible" used herein may, but does not necessarily, indicate that the compounds or additives are soluble, dissolvable, miscible, or capable of being suspended in the oil in all proportions. The foregoing terms do mean, however, that they are, for instance, soluble, suspendable, dissolvable, or stably dispersible in oil to an extent sufficient to exert their intended effect in the environment in which the oil is employed. Moreover, the additional incorporation of other additives may also permit incorporation of higher levels of a particular additive, if desired.

The term "alkyl" as employed herein refers to straight, branched, cyclic, and/or substituted saturated chain moieties from about 1 to about 200 carbon atoms. In one embodiment it refers to straight, branched or cyclic chain moieties which are unsubstituted.

The term "alkenyl" as employed herein refers to straight, branched, cyclic, and/or substituted unsaturated chain moieties from about 3 to about 30 carbon atoms. In one embodiment it refers to straight, branched or cyclic chain moieties which are unsubstituted.

The term "aryl" as employed herein refers to single and multi-ring aromatic compounds that may include alkyl, alkenyl, alkylaryl, amino, hydroxyl, alkoxy, halo substituents, and/or heteroatoms including, but not limited to, nitrogen, and oxygen.

As used herein, the "average number molecular weight" or "Mn" is determined by gel permeation chromatography (GPC) using commercially available polystyrene standards (with a Mn of about 180 to about 18,000 as the calibration reference).

It is to be understood that throughout the present disclosure, the terms "comprises," "includes," "contains," etc. are considered open-ended and include any element, step, or ingredient not explicitly listed. The phrase "consists essentially of" is meant to include any expressly listed element, step, or ingredient and any additional elements, steps, or ingredients that do not materially affect the basic and novel aspects of the invention. The present disclosure also contemplates that any composition described using the terms, "comprises," "includes," "contains," is also to be interpreted as including a disclosure of the same composition "consisting essentially of" or "consisting of" the specifically listed components thereof.

EXAMPLES

A better understanding of the present disclosure and its many advantages may be further clarified with the following examples. The following examples are illustrative and not limiting in either scope or spirit. Those skilled in the art will readily understand that variations of the components, methods, steps, and devices described in these examples can be used. Unless noted otherwise or apparent from the context of discussion in the examples below and throughout this disclosure, claims, and examples, all percentages, ratios, and parts noted in this disclosure are by weight. Any standardized test method noted in the examples, disclosure, or claims, unless apparent from the context of its use, refers to the version of the test method publicly available at the time of the filing of the present disclosure.

Examples of lubricant compositions described herein were prepared and evaluated for performance. The Working Examples and Comparative Examples were prepared according to the compositions in Table 3 and tested according to the standard tests in Table 4. The Inventive formulations of Examples 1 and 2, shown in Table 3, included identical amounts of an alkyl triazole derivative as the corrosion inhibitor and the same amounts of ashless dithiophosphate. Examples 1 and 2 differed in that Example 1 used a primary ZDDP whereas Example 2 contained a secondary (branched) ZDDP. The Comparative Examples 1-5 had one or more of the three primary ingredients missing or used tolytriazole or a derivative thereof as the corrosion inhibitor. Each evaluated lubricant included the same base additive package (other than the metal dithiophosphate, ashless dithiophosphate and corrosion inhibitor components (as noted in Table 3)) and contained the same dispersants, antioxidants, antifoam agents, and viscosity modifiers. The Inventive and Comparative formulations were tested in the same base oil blend of API Group II base oils with treat rates to obtain finished fluids having a kV100° C. of approximately 9 cSt (ASTM D445).

TABLE 3

| | Ex 1 | Ex 2 | Comp 1 | Comp 2 | Comp 3 | Comp 4 | Comp 5 |
|---|---|---|---|---|---|---|---|
| Ashless Dithiophosphate (ppm P) | 25 | 25 | — | — | 193 | 25 | 25 |
| Primary ZDDP (ppm P) | 168 | — | — | 193 | — | 168 | 168 |
| Secondary ZDDP (ppm P) | — | 168 | — | — | — | — | — |
| C1 (ppm N) | 1.5 | 1.5 | 1.5 | 1.5 | 1.5 | — | — |
| C2 (ppm N) | — | — | — | — | — | 1.5 | — |
| C3 (ppm N) | — | — | — | — | — | — | 1.5 |
| Total P (ppm) | 193 | 193 | 0 | 193 | 193 | 193 | 193 |
| Hydrolytic stability 96-hr (loss, mg/cm$^2$) (ASTM D2619-21) | 0.09 | 0.08 | 0.03 | 0.31 | 0.24 | 0.86 | 0.30 |

TABLE 3-continued

| | Ex 1 | Ex 2 | Comp 1 | Comp 2 | Comp 3 | Comp 4 | Comp 5 |
|---|---|---|---|---|---|---|---|
| RPVOT (mins) (ASTM D2272-22) | 492 | 497 | 183 | 478 | 297 | 453 | 480 |
| 4-Ball Wear (mm) (ASTM D4172-21) | 0.55 | 0.53 | 0.86 | 0.55 | 0.48 | 0.55 | 0.52 |

The ashless dithiophosphate was 3-[[bis(2-methylpropoxy)phosphinothioyl]thio]-2-methyl-propanoic acid, available from BASF (Ludwigshafen, Germany) as Irgalube® 353.

Primary ZDDP was a conventional ZDDP available, e.g., as HiTEC® 680, from Afton Chemical Corp. of Richmond, VA.

Secondary ZDDP was a conventional ZDDP available, e.g., as HiTEC® 704, from Afton Chemical Corp. of Richmond, VA.

Corrosion inhibitor 1 (C1) was Cuvan™ 313, available from Vanderbilt Worldwide Ltd. (Nantwich, UK). Cuvan™ 313 is 1H-1,2,4-Triazole-1-methanamine, N,N-bis(2-ethylhexyl).

Corrosion inhibitor 2 (C2) was Irgamet® 39, available from BASF (Ludwigshafen, Germany). Irgamet® 39 is a tolytriazole derivative.

Corrosion inhibitor 3 (C3) was Cobratec® TT-100, available from Sherwin-Williams. TT-100 is Tolytriazole.

Each of the lubricant compositions were formulated to provide a targeted concentration of phosphorus (P) and nitrogen (N) as shown in Table 3.

TABLE 4

| | |
|---|---|
| ASTM D2619-21 | Standard Test Method for Hydrolytic Stability of Hydraulic Fluids, modified to test at 96 hours. |
| ASTM D2272-22 | Standard Test Method for Oxidation Stability of Steam Turbine Oils by Rotating Pressure Vessel |
| ASTM D4172-21 | Standard Test Method for Wear Preventive Characteristics of Lubricating Fluid (Four-Ball Method) |

In Inventive Examples 1 and 2, the combination of ashless dithiophosphate, metal dithiophosphate and an alkylated triazole derivative provided both wear protection and oxidation protection while providing hydrolytic stability. In the event no phosphorus compound was used, the hydrolytic stability of the fluid was maintained, however, the fluid exhibited poorer performance in the oxidation test and the antiwear test, e.g., Comparative Ex. 1. If the amount of overall phosphorus was maintained as in Inventive Examples 1 and 2, but no ashless dithiophosphate was used, the lubricant became hydrolytically unstable e.g., Comparative Ex. 2. In Comparative Ex. 3, the overall amount of phosphorus was maintained and the desired antiwear performance was preserved, however, in the absence of the metal dithiophosphate the oxidation performance was poor and the lubricant was hydrolytically unstable. If the identical antiwear systems used in the inventive examples were used but the corrosion inhibitor was tolytriazole or a derivative thereof, the lubricant's oxidation protection dropped and the lubricant became less hydrolytically stable, e.g., Comparative Ex. 4 and 5.

The combination of antiwear and alkylated triazole were able to provide protection in all three of the desired hydraulic fluid properties.

Whereas various examples of the disclosure have been described in fulfillment of the various objectives of the disclosure, it should be recognized that these examples are merely illustrative of the principles of the present disclosure. Numerous modifications and adaptations thereof will be readily apparent to those skilled in the art without departing from the spirit and scope of the present disclosure as defined in the following claims.

Other embodiments of the present disclosure will be apparent to those skilled in the art from consideration of the specification and practice of the embodiments disclosed herein. As used throughout the specification and claims, "a" and/or "an" may refer to one or more than one. Unless otherwise indicated, all numbers expressing quantities of ingredients, properties such as molecular weight, percent, ratio, reaction conditions, and so forth used in the specification are to be understood as being modified in all instances by the term "about," whether or not the term "about" is present. Accordingly, unless indicated to the contrary, the numerical parameters set forth in the specification are approximations that may vary depending upon the desired properties sought to be obtained by the present disclosure. At the very least, and not as an attempt to limit the application of the doctrine of equivalents to the scope of the claims, each numerical parameter should at least be construed in light of the number of reported significant digits and by applying ordinary rounding techniques. Notwithstanding that the numerical ranges and parameters setting forth the broad scope of the disclosure are approximations, the numerical values set forth in the specific examples are reported as precisely as possible. Any numerical value, however, inherently contains certain errors necessarily resulting from the standard deviation found in their respective testing measurements.

It is to be understood that each component, compound, substituent or parameter disclosed herein is to be interpreted as being disclosed for use alone or in combination with one or more of each and every other component, compound, substituent or parameter disclosed herein.

It is further understood that each range disclosed herein is to be interpreted as a disclosure of each specific value within the disclosed range that has the same number of significant digits. Thus, a range of from 1 to 4 is to be interpreted as an express disclosure of the values 1, 2, 3 and 4 as well as any range of such values such as 1 to 4, 1 to 3, 1 to 2, 2 to 4, 2 to 3 and so forth.

It is further understood that each lower limit of each range disclosed herein is to be interpreted as disclosed in combination with each upper limit of each range and each specific value within each range disclosed herein for the same component, compounds, substituent or parameter. Thus, this disclosure to be interpreted as a disclosure of all ranges derived by combining each lower limit of each range with each upper limit of each range or with each specific value within each range, or by combining each upper limit of each range with each specific value within each range.

Furthermore, specific amounts/values of a component, compound, substituent or parameter disclosed in the description or an example is to be interpreted as a disclosure of either a lower or an upper limit of a range and thus can be combined with any other lower or upper limit of a range or specific amount/value for the same component, compound, substituent or parameter disclosed elsewhere in the application to form a range for that component, compound, substituent or parameter.

It is to be understood that while the lubricating composition and compositions of this disclosure have been described in conjunction with the detailed description thereof and summary herein, the foregoing description is intended to illustrate and not limit the scope of the disclosure, which is defined by the scope of the appended claims. Other aspects, advantages, and modifications are within the scope of the claims. It is intended that the specification and examples be considered as exemplary only, with a true scope of the disclosure being indicated by the following claims.

ILLUSTRATIVE EMBODIMENTS

The following numbered clauses (1) to (27) represent embodiments of the invention. These clauses are not the claims of the present application. The claims appear in a subsequent section beneath Illustrative embodiments (1) to (27).

As used below, any reference to compositions, methods, systems, or uses is to be understood as a reference to each of those compositions, methods, systems, or uses disjunctively (e.g., "Illustrative embodiments (1) to (4) is to be understood as Illustrative embodiment (1), (2), (3), or (4)").

Illustrative embodiment (1): A lubricant composition comprising:

an ashless dithiophosphate;

a metal dialkyl dithiophosphate;

a corrosion inhibitor comprising an alkyltriazole derivative in an amount sufficient to provide a concentration of nitrogen ranging from 0.75 ppm to 100 ppm to the lubricant composition; and a major amount of a base oil.

Illustrative embodiment (2): The lubricant composition of (1), wherein the ashless dithiophosphate comprises 3-[[bis(2-methylpropoxy)phosphinothioyl]thio]-2-methyl-propanoic acid, ethyl 3-[[bis(1-methylethoxy)phosphinothioyl]thio]propionate, or a combination thereof.

Illustrative embodiment (3): The lubricant composition of (1) or (2), wherein the ashless dithiophosphate is present in an amount sufficient to provide a concentration of phosphorus ranging from 10 ppm to 250 ppm or from 8 ppm to 40 ppm to the lubricant composition.

Illustrative embodiment (4): The lubricant composition of any one of (1) to (3), wherein the metal dialkyl dithiophosphate comprises (or is) zinc dialkyl dithiophosphate (ZDDP), wherein the ZDDP comprises a primary ZDDP, a secondary ZDDP, or a combination thereof.

Illustrative embodiment (5): The lubricant composition of any one of (1) to (4), wherein the metal dialkyl dithiophosphate is present in an amount sufficient to provide a concentration of phosphorus ranging from 50 ppm to 1000 ppm or from 50 ppm to 300 ppm to the lubricant composition.

Illustrative embodiment (6): The lubricant composition of any one of (1) to (5), wherein the corrosion inhibitor comprises 1H-1,2,4-Triazole-1-methanamine, N,N-bis(2-ethylhexyl).

Illustrative embodiment (7): The lubricant composition of any one of (1) to (6), wherein the corrosion inhibitor is present in an amount sufficient to provide a concentration of nitrogen ranging from 0.75 ppm to 15 ppm to the lubricant composition.

Illustrative embodiment (8): The lubricant composition of any one of (1) to (7), wherein the corrosion inhibitor is substantially free of (in other embodiments free of) benzotriazole and benzotriazole derivatives.

Illustrative embodiment (9): The lubricant composition of any one of (1) to (8), wherein the corrosion inhibitor is substantially free of (in other embodiments free of) tolytriazole and tolytriazole derivatives.

Illustrative embodiment (10): The lubricant composition of any one of (1) to (9), wherein the composition has a copper weight loss in the hydrolytic stability test of 0.2 $mg/cm^2$ or less as measured according to ASTM D2619-21 over 96 hours.

Illustrative embodiment (11): The lubricant composition of any one of (1) to (10), wherein the composition has a Rotating Pressure Vessel Oxidation Test (RPVOT) value of at least 350 mins as measured according to ASTM D2272-22.

Illustrative embodiment (12): The lubricant composition of any one of (1) to (11), wherein the composition has a 4-ball wear value of less than 0.60 mm as measured according to ASTM D4172-21.

Illustrative embodiment (13): The lubricant composition of any one of (1) to (12), further comprising a dispersant, a detergent, a friction modifier, or combinations thereof.

Illustrative embodiment (14): The lubricant composition of any one of (1) to (12), comprising (or consisting essentially of), in addition to the ashless dithiophosphate, metal dialkyl dithiophosphate, and corrosion inhibitor, the following components:

corrosion inhibitor in an amount of 0 to 1 wt. % (or 0.04 to 0.5 wt. %);

detergent(s) in an amount of 0.05 to 0.5 wt. % (or 0.08 to 0.3 wt. %);

dispersant(s) in an amount of 0.1 to 2 wt. % (or 0.15 to 1 wt. %);

sulfurized component(s) in an amount of 0.05 to 1.5 wt. % (or 0.2 to 1 wt. %);

antiwear additive(s) in an amount of 0.01 to 1.5 wt. % (or 0.05 to 0.5 wt. %);

antioxidant(s) in an amount of 0.05 to 0.6 wt. % (or 0.1 to 0.5 wt. %);

antifoaming agent(s) in an amount of 0 to 0.05 wt. % (or 0.01 to 0.04 wt. %);

viscosity index improver(s) in an amount of 0 to 10 wt. % (or 0 to 5 wt. %); and a balance of base oil.

Illustrative embodiment (15): The lubricant composition of any one of (1) to (12), comprising, in addition to the ashless dithiophosphate, metal dialkyl dithiophosphate, corrosion inhibitor and base oil, the following components:

dispersant(s), e.g. in an amount of 0.1 to 2 wt. % (or 0.15 to 1 wt. %);

antioxidant(s), e.g. in an amount of 0.05 to 0.6 wt. % (or 0.1 to 0.5 wt. %);

antifoaming agent(s), e.g. in an amount of 0 to 0.05 wt. % (or 0.01 to 0.04 wt. %); and viscosity index improver(s), e.g. in an amount of 0 to 10 wt. % (or 0 to 5 wt. %).

Illustrative embodiment (16): A hydraulic system comprising a lubricant composition as defined in any one of (1) to (15).

Illustrative embodiment (17): A method for lubricating a hydraulic component comprising lubricating the component with a lubricant composition as defined in any one of (1) to (15).

Illustrative embodiment (18): The method of (17), wherein the hydraulic component is used in a vehicular application, a mobile application, or an industrial application.

Illustrative embodiment (19): The method of (18), wherein the mobile application comprises construction equipment.

Illustrative embodiment (20): The method of (19), wherein the construction equipment comprises wheel loaders, excavators, backhoes, bulldozers, graders, skid steers, articulated trucks, compact track loaders, or compactors.

Illustrative embodiment (21): The method of (18), wherein the industrial application comprises off-shore oil and gas, cement manufacturing, off-road, assembly plant, sub-sea hydraulics, pulp and paper, glass, dockyards, food processing, marine, power generation, rubber and plastics, or metal manufacturing.

Illustrative embodiment (22): A method of making a lubricant composition comprising combining an ashless dithiophosphate, a metal dialkyl dithiophosphate, a corrosion inhibitor comprising an alkyltriazole derivative, and a major amount of a base oil to produce a lubricant composition as defined in any one of (1) to (15).

Illustrative embodiment (23): The use, in a hydraulic fluid, of an ashless dithiophosphate, a metal dialkyl dithiophosphate, and a corrosion inhibitor comprising an alkyltriazole derivative, to inhibit wear and oxidation while also maintaining hydrolytic stability, wherein preferably the hydraulic fluid is as defined in any one of (1) to (15).

Illustrative embodiment (24): The use, in a hydraulic fluid, of an ashless dithiophosphate to inhibit wear and oxidation while also maintaining the hydrolytic stability of the fluid, wherein the hydraulic fluid comprises a metal dialkyl dithiophosphate in an amount sufficient to provide a concentration of phosphorus ranging from 50 ppm to 1000 ppm to the lubricant composition, plus a corrosion inhibitor comprising an alkyltriazole derivative in an amount sufficient to provide a concentration of nitrogen ranging from 0.75 ppm to 100 ppm to the lubricant composition; and wherein preferably the hydraulic fluid is as defined in any one of (1) to (15).

Illustrative embodiment (25): The use, in a hydraulic fluid, of a metal dialkyl dithiophosphate to inhibit wear and oxidation while also maintaining the hydrolytic stability of the fluid, wherein the hydraulic fluid comprises an ashless dithiophosphate in an amount sufficient to provide a concentration of phosphorus ranging from 10 ppm to 250 ppm to the lubricant composition, plus a corrosion inhibitor comprising an alkyltriazole derivative in an amount sufficient to provide a concentration of nitrogen ranging from 0.75 ppm to 100 ppm to the lubricant composition; and wherein preferably the hydraulic fluid is as defined in any one of (1) to (15).

Illustrative embodiment (26): The use, in a hydraulic fluid, of an ashless dithiophosphate in combination with a metal dialkyl dithiophosphate to inhibit wear and oxidation while also maintaining the hydrolytic stability of the fluid, wherein the hydraulic fluid comprises an alkyltriazole derivative in an amount sufficient to provide a concentration of nitrogen ranging from 0.75 ppm to 100 ppm to the lubricant composition; and wherein preferably the hydraulic fluid is as defined in any one of (1) to (15).

Illustrative embodiment (27): The use, in a hydraulic fluid, of a corrosion inhibitor comprising an alkyltriazole derivative to improve hydrolytic stability and inhibit oxidation while also maintaining the antiwear performance of the fluid, wherein the hydraulic fluid comprises an ashless dithiophosphate in an amount sufficient to provide a concentration of phosphorus ranging from 10 ppm to 250 ppm to the lubricant composition, plus a metal dialkyl dithiophosphate in an amount sufficient to provide a concentration of phosphorus ranging from 50 ppm to 1000 ppm to the lubricant composition; and wherein preferably the hydraulic fluid is as defined in any one of (1) to (15).

What is claimed is:

1. A lubricant composition comprising:

an ashless dithiophosphate;

a metal dialkyl dithiophosphate;

a corrosion inhibitor comprising an alkyltriazole derivative in an amount sufficient to provide a concentration of nitrogen ranging from 0.75 ppm to 100 ppm to the lubricant composition;

a major amount of a base oil; and wherein the corrosion inhibitor is substantially free of benzotriazole and benzotriazole derivatives and substantially free of tolyltriazole and tolyltriazole derivatives.

2. The lubricant composition of claim 1, wherein the ashless dithiophosphate comprises 3-[[bis(2-methylpropoxy)phosphinothioyl]thio]-2-methyl-propanoic acid, ethyl 3-[[bis(1-methylethoxy)phosphinothioyl]thio]propionate, or a combination thereof.

3. The lubricant composition of claim 1, wherein the ashless dithiophosphate is present in an amount sufficient to provide a concentration of phosphorus ranging from 10 ppm to 40 ppm to the lubricant composition.

4. The lubricant composition of claim 1, wherein the metal dialkyl dithiophosphate comprises a primary zinc dialkyl dithiophosphate (ZDDP), a secondary ZDDP, or a combination thereof.

5. The lubricant composition of claim 1, wherein the metal dialkyl dithiophosphate is present in an amount sufficient to provide a concentration of phosphorus ranging from 50 ppm to 300 ppm to the lubricant composition.

6. The lubricant composition of claim 1, wherein the corrosion inhibitor comprises 1H-1,2,4-Triazole-1-methanamine, N,N-bis(2-ethylhexyl).

7. The lubricant composition of claim 1, wherein the corrosion inhibitor is present in an amount sufficient to provide a concentration of nitrogen ranging from 0.75 ppm to 15 ppm to the lubricant composition.

8. The lubricant composition of claim 1, wherein the composition has a copper weight loss in the hydrolytic stability test of 0.2 $mg/cm^2$ or less as measured according to ASTM D2619-21 over 96 hours.

9. The lubricant composition of claim 1, wherein the composition has a Rotating Pressure Vessel Oxidation Test (RPVOT) value of at least 350 mins as measured according to ASTM D2272-22.

10. The lubricant composition of claim 1, wherein the composition has a 4-ball wear value of less than 0.60 mm as measured according to ASTM D4172-21.

11. The lubricant composition of claim 1, further comprising a dispersant, a detergent, a friction modifier, or combinations thereof.

12. A hydraulic system comprising the lubricant composition of claim 1.

13. A method for lubricating a hydraulic component comprising lubricating the component with the lubricant composition according to claim 1.

14. The method of claim 13, wherein the hydraulic component is used in a vehicular application, a mobile application, or an industrial application.

15. The method of claim 14, wherein the mobile application comprises construction equipment.

16. The method of claim 15, wherein the construction equipment comprises wheel loaders, excavators, backhoes, bulldozers, graders, skid steers, articulated trucks, compact track loaders, or compactors.

17. The method of claim 14, wherein the industrial application comprises off-shore oil and gas, cement manufacturing, off-road, assembly plant, sub-sea hydraulics, pulp and paper, glass, dockyards, food processing, marine, power generation, rubber and plastics, or metal manufacturing.

18. A method of making a lubricant composition comprising:

combining an ashless dithiophosphate, a metal dialkyl dithiophosphate, a corrosion inhibitor comprising an alkyltriazole derivative, and a major amount of a base oil to produce the lubricant composition of claim 1.

* * * * *